US008100286B2

(12) United States Patent
Chinni Vergottini

(10) Patent No.: US 8,100,286 B2
(45) Date of Patent: Jan. 24, 2012

(54) TIE SYSTEM FOR PLASTIC CONTAINERS

(75) Inventor: Pedro Chinni Vergottini, Santiago (CL)

(73) Assignee: Wenco S.A., Santiago (CL)

( * ) Notice: Subject to any disclaimer, the term of this patent is extended or adjusted under 35 U.S.C. 154(b) by 158 days.

(21) Appl. No.: 12/541,576

(22) Filed: Aug. 14, 2009

(65) Prior Publication Data

US 2010/0186196 A1 Jul. 29, 2010

(30) Foreign Application Priority Data

Jan. 26, 2009 (CL) ..... 158-2009

(51) Int. Cl.
*B65D 1/42* (2006.01)
*B65D 6/34* (2006.01)
*B65D 8/08* (2006.01)

(52) U.S. Cl. ..... 220/653

(58) Field of Classification Search ..... 220/4.16, 220/4.33, 6, 652, 653
See application file for complete search history.

(56) References Cited

U.S. PATENT DOCUMENTS 6,145,682 A * 11/2000 Speck et al. ..... 220/1.5
6,792,892 B2 * 9/2004 Craig ..... 119/502
2007/0108203 A1 * 5/2007 Vroon ..... 220/1.5

* cited by examiner

*Primary Examiner* — Harry Grosso
(74) *Attorney, Agent, or Firm* — Hamre, Schumann, Mueller & Larson, P.C.

(57) ABSTRACT

A tie system for plastic containers intended to provide greater rigidity and stability, wherein each tie comprises a central bar having two ends with clasps that fit with protuberances existing in the container.

6 Claims, 3 Drawing Sheets

TIE SYSTEM FOR PLASTIC CONTAINERS

FIELD OF THE INVENTION

The present application relates to a tie system to be used in plastic containers or boxes, for storing and transporting all kind of fresh food, such as horticultural produce, meat (beef, fish, port, etc.) or the like.

DESCRIPTION OF THE INVENTION

Normally, plastic boxes or containers are self-supporting, the joint strength and rigidity existing between the side walls and the bottom just sufficing thereto, and which allows only a certain amount of pressure upon said side walls and bottom, its filling capacity being limited to the strength generated by certain volume of product and its specific density that exerts pressure on the side walls, which tends to open and distort the box or container, making difficult their piling up and stability, ad may cause said walls and bottom to break.

BRIEF DESCRIPTION OF THE INVENTION

This specification relates to a system comprising a couple of plastic ties, their ends having holes, each forming a first portion of a clasp, and which runs from a protuberance forming a second portion of a clasp system located close, or at one of the four vertexes of a regular rectangular plastic box, to another protuberance or second portion of a clasp system located close or at the vertex diagonally opposite to said plastic box, said ties increasing the rigidity and stability of the entire box, the box keeping its rectangular shape, causing the side walls and the box or container to distort less.

In another embodiment of the present application, the fastening of the ties to the box may be made by way of screws, a clip or any other mechanism used to fasten the ties to the box.

DETAILED DESCRIPTION

Figure 1:
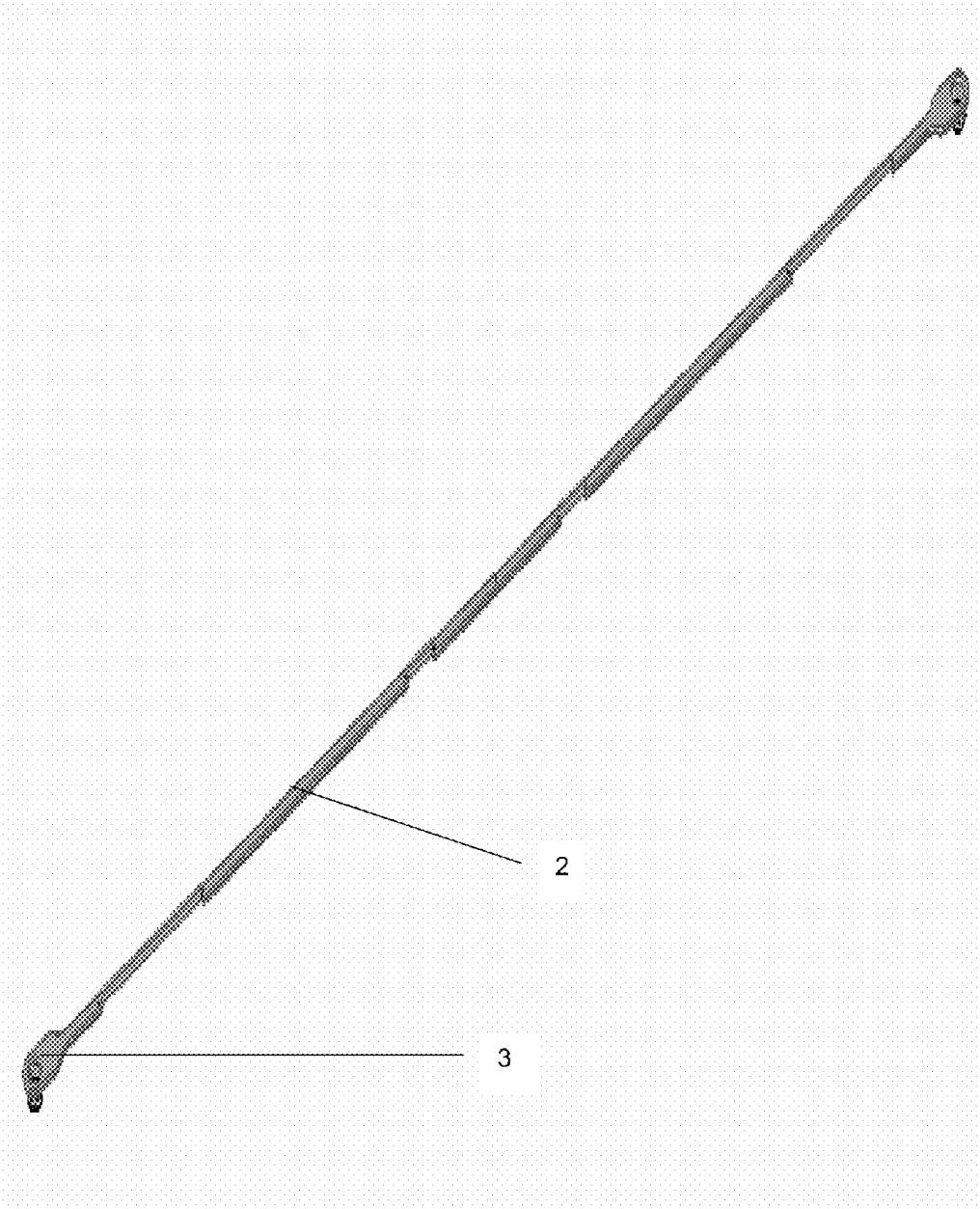
FIG. 1 shows a whole tie.
Figure 2:
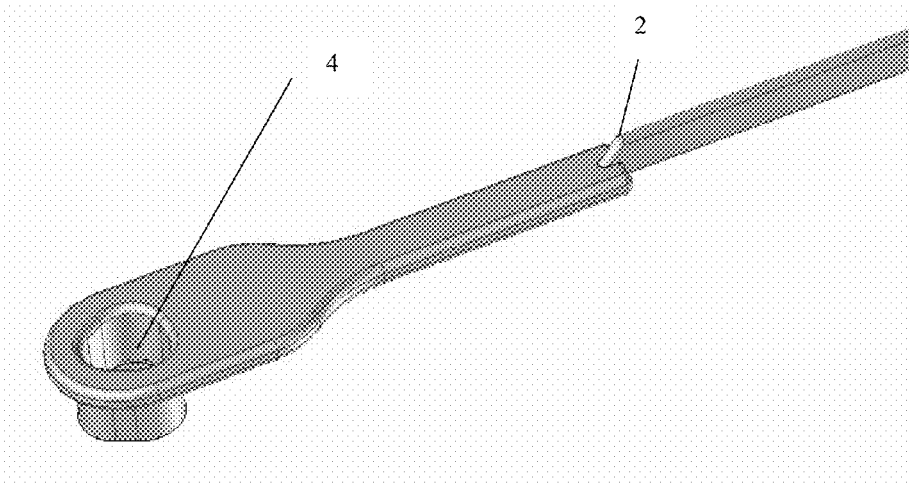
FIG. 2 shows details of the ends of a tie.
Figure 3:
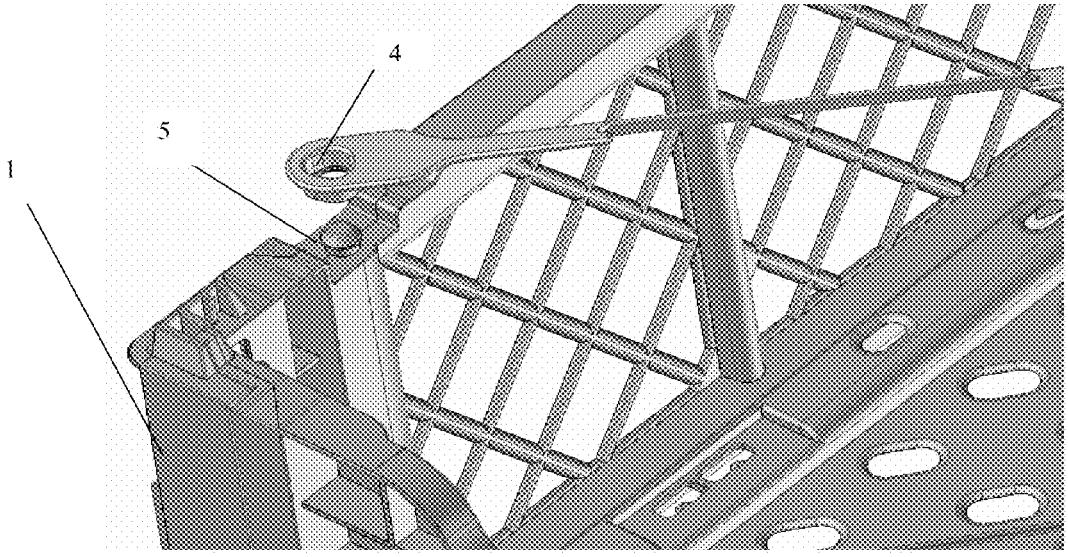
FIG. 3 shows the mechanism through which the tie is fastened to the box or container.
Figure 4:
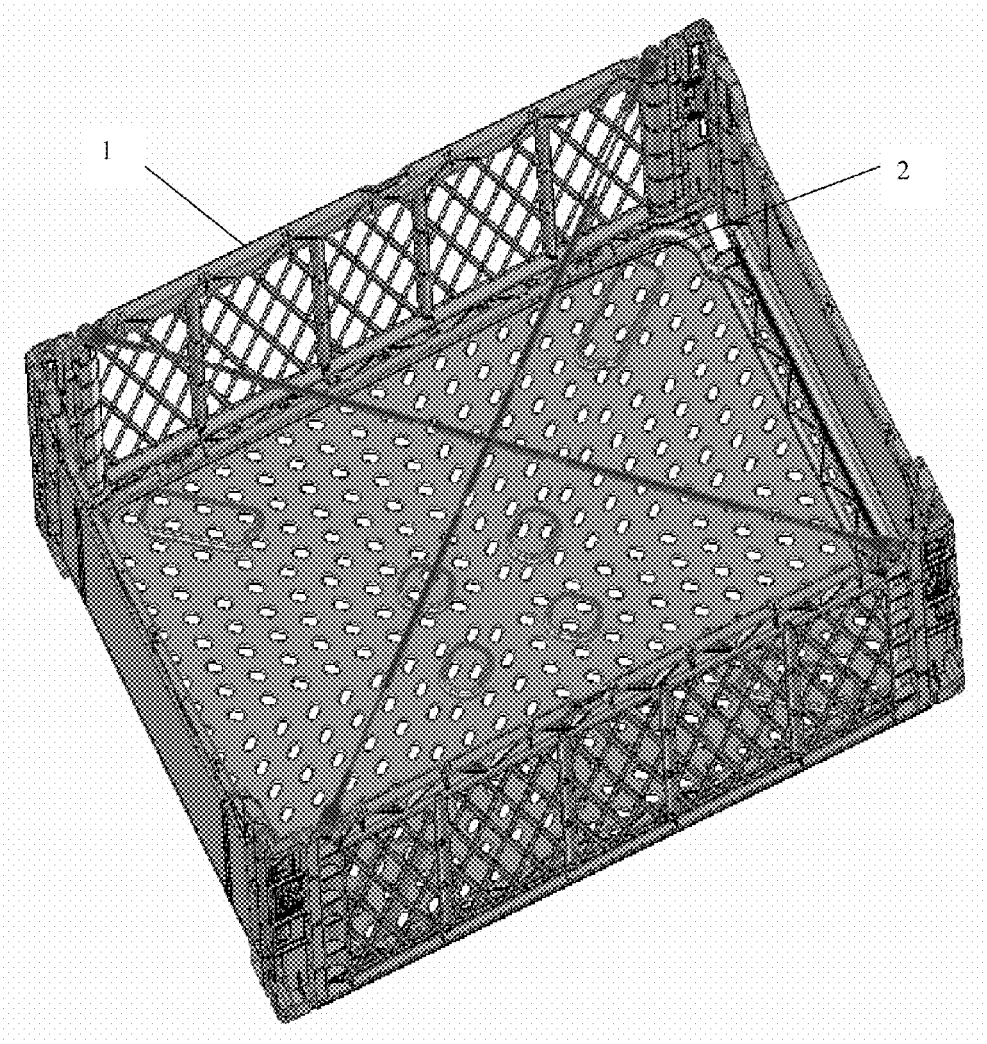
FIG. 4 shows the whole box or container and the way the ties are installed.

The present utility model comprises two plastic ties each comprising a central bar (2), which, in turn, has two ends (3) having a hole or a first portion of a clasp (4) at each one of said ends (3). These ties are installed by locating them diagonally, joining two diagonally opposite vertexes of the box or container (1), as shown in FIG. 4. A protuberance or second portion of a clap is located at, or close to, one of the vertexes of the box or container, the hole (4), being located at one of the ends (3) of the ties being pressure-inserted thereon. The action is then repeated with the other tie by using protuberances or second portions of a clasp in the box being diagonally free.

What is claimed is:

1. A plastic tie system for a plastic box intended to provide greater rigidity and stability to the plastic box, the system comprises:

first and second plastic ties, each of the plastic ties includes a central bar having first and second ends, the first and second ends each including a first portion of a clasp system; and the plastic box includes a bottom wall and a plurality of side walls extending upwardly from the bottom wall to upper ends, the side walls defining first, second, third and fourth corners of the plastic box, the first and third corners being disposed diagonally opposite each other and the second and fourth corners being disposed diagonally opposite each other;

the side walls of the plastic box include second portions of the clasp system adjacent the upper ends thereof and adjacent the first, second, third and fourth corners, the second portions of the clasp system are configured to engage with the first portions of the clasp system on the first and second ends of the plastic ties to secure the plastic ties to the plastic box, wherein the first plastic tie is secured diagonally across the plastic box with the first portions of the clasp system at the first and second ends thereof engaged with the second portions of the clasp system adjacent the first and third opposite corners of the plastic box, and the second plastic tie is secured diagonally across the plastic box with the first portions of the clasp system at the first and second ends thereof engaged with the second portions of the clasp system adjacent the second and fourth opposite corners of the plastic box.

2. The plastic tie system according to claim 1, wherein the second portions of the clasp system comprise protuberances on the side walls with the protuberances located adjacent to or at the first, second, third and fourth corners of the plastic box, and the first portions of the clasp system comprise holes in the first and second ends of the plastic ties that are configured to receive the protuberances.

3. The plastic tie system according to claim 1, wherein the first and second portions of the clasp system are secured via pressure, screwed together, or clipped together.

4. The plastic tie system according to claim 1, wherein the plastic box includes an open top opposite the bottom wall, and the first and second plastic ties extend across the open top.

5. The plastic tie system according to claim 1, wherein the second portions of the clasp system adjacent to the first, second, third and fourth corners are on two of the side walls.

6. The plastic tie system according to claim 2, wherein the protuberances are disposed in upwardly facing recesses formed on the side walls.

* * * * *